US005429207A

United States Patent [19]

Frank et al.

[11] Patent Number: 5,429,207

[45] Date of Patent: Jul. 4, 1995

[54] RUNG LOCK AND LATCH ASSEMBLY FOR AN EXTENSION LADDER

[75] Inventors: William H. Frank, Anchorage; Claude R. Wallick, Jr., Louisville, both of Ky.

[73] Assignee: Emerson Electric Co., St. Louis, Mo.

[21] Appl. No.: 197,745

[22] Filed: Feb. 17, 1994

[51] Int. Cl.[6] ..... E06C 7/06

[52] U.S. Cl. ..... 182/209

[58] Field of Search ..... 182/209–213

[56] References Cited

U.S. PATENT DOCUMENTS

| | | | |
|---|---|---|---|
| 613,848 | 11/1898 | Seagrave . | |
| 802,017 | 10/1905 | Newton . | |
| 873,110 | 12/1907 | Williamson | 182/213 |
| 1,113,413 | 10/1914 | Conabee | 182/211 |
| 1,210,827 | 1/1917 | Myers | 182/210 |
| 3,565,211 | 2/1971 | Leblanc | 182/211 |
| 4,299,306 | 11/1981 | Hawkins | 182/210 |
| 5,117,943 | 6/1992 | Schmitt et al. . | |

FOREIGN PATENT DOCUMENTS

| | | | |
|---|---|---|---|
| 748515 | of 0000 | United Kingdom | 182/213 |
| 12498 | of 1913 | United Kingdom | 182/212 |

*Primary Examiner*—Alvin C. Chin-Shue

*Attorney, Agent, or Firm*—Polster, Lieder, Woodruff & Lucchesi

[57] ABSTRACT

A rung lock frame and a mechanical latching structural assembly for selectively releasably locking and releasably and augmentally latching a pair of adjacently positioned rungs of relatively slidable ladder sections of an extension ladder, the rung lock frame and latching structure including guide rib and inclined ramp arrangement to permit ready movement of said latching structure into and out of augmental latching position on the rung lock frame.

10 Claims, 2 Drawing Sheets

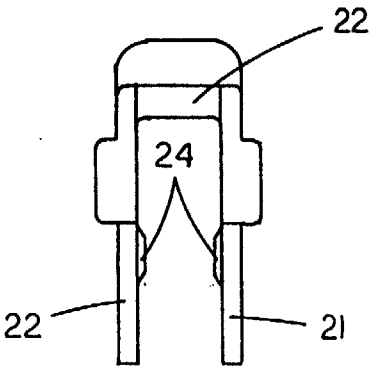
FIG. 5
FIG. 4
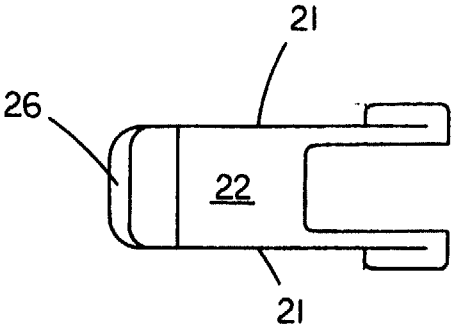
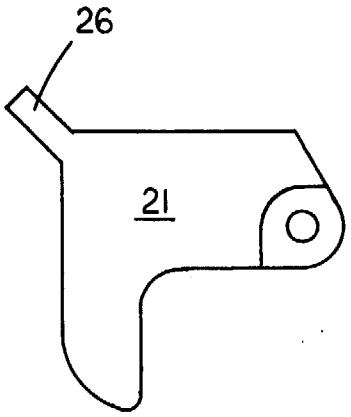
FIG. 3
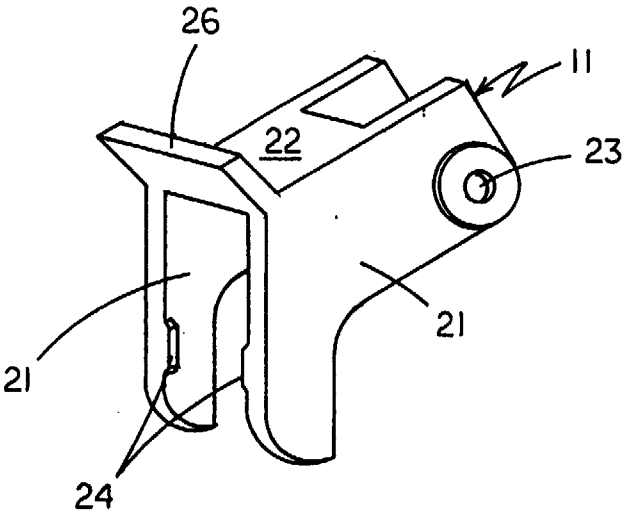
FIG. 2

RUNG LOCK AND LATCH ASSEMBLY FOR AN EXTENSION LADDER

BACKGROUND OF THE INVENTION

The present invention relates to extension ladders including adjacent relatively slidable ladder sections and more particularly to rung locks for holding movable fly ladder sections in a selected longitudinal position with respect to adjacent ladder sections, which usually are the stationary or base ladder sections, and to a unique latching structures which can be associated with the rung locks.

Numerous mechanisms for engaging the rungs or stations of an extension ladder to lock a movable fly ladder section to a base section are generally known in the ladder industry. In this regard attention is directed to the rung locks disclosed in such long expired U.S. Pat. Nos. 613,848, issued to F. S. Seagrave on Nov. 8, 1898; 802,017, issued to F. T. Newton on Oct. 17, 1905; British patent No. 748,515, issued to C. W. Catless on May 2, 1956; and to more recently issued U.S. Pat. Nos. 4,229,306 issued to H. G. Hawkins on Nov. 10, 1981 and 5,117,943, issued to T. J. Schmitt et al on Jun. 2, 1992. Each of these aforedescribed patents teaches a rang lock frame pivotally mounted on the side rail of a fly section of an extensible ladder, the frame being shaped and sized to engage adjacent rungs of adjacent, relatively movable ladder sections so as to hold relatively movable ladder sections together in a selected longitudinal position.

It also has long been known to further recommend tying the bottom fly to an adjacent base rung with a rope, such an augmenting recommendation usually being printed on labels attached to extension ladders.

The present invention provides a unique rung lock frame and latching structure assembly which equally affords the convenience and augmentation of adjacent rung tying with a straight forward and economical structural arrangement which can be readily manufactured, assembled and maintained with a minimum of operating steps required of the extension ladder user, further enhancing rung lock structure to limit moveability of such structure when in operating position.

Various other features of the present invention will become obvious to one skilled in the art upon reading the disclosure set forth herein.

BRIEF SUMMARY OF THE INVENTION

More particularly the present invention provides in combination with an extension ladder having at least two adjacent relatively slidable ladder sections, each section of which includes a plurality of spaced rungs normally extending between and fastened to a pair of spaced ladder rails, one of the ladder sections serving as a base ladder section and the other serving as a movable fly ladder section, a rung lock frame and latching assembly for selectively, releasably locking and releasably latching a pair of adjacently positioned rungs of the relatively slidable ladder sections, comprising rung lock frame means movably suspended relative the adjacent relatively slidable ladder sections, the rung lock frame means including a mouth portion geometrically sized and configured to releasably engage both of a pair of adjacently positioned rungs of the adjacently relatively slidable ladder sections; and, mechanical latching means movably mounted on one of the ladder sections to be releasably cooperable relative the pair of adjacently positioned rungs when so releasably engaged to extend in the mouth portion of the rung lock frame means to limit rung movement, thus releasably augmentingly fastening the rung lock frame means in rung engaged position. In addition, the present invention provides in combination with a rung lock frame for releasably engaging and locking oppositely positioned rungs of relatively slidable ladder sections of an extension ladder, a latching structure geometrically shaped to have a first extremity thereof pivotally mounted on the rung lock frame and a second extremity thereof positioned to limit releasing movement of the rung lock frame relative oppositely positioned rungs engaged by the rung lock frame. Further, the present invention provides a unique inclined ramp and guide rib assembly cooperatively disposed between the rung lock frame and latching structure mounted thereon.

It is to be understood that various changes can be made by one skilled in the art in one or more of the several parts of the structure disclosed herein without departing from the scope or spirit of the present invention.

BRIEF DESCRIPTION OF THE DRAWINGS

Referring to the drawings which disclose one advantageous embodiment of the present invention.

FIG. 2 fan enlarged perspective view of the novel latch structure of the present invention;

FIG. 3 is a side view of the latch structure of FIG. 2;

FIG. 4 is a top view of the latch structure of FIG. 3; and

FIG. 5 is a right hand end view of the latch structure of FIG. 3.

DETAILED DESCRIPTION OF THE DRAWINGS

Figure 1:
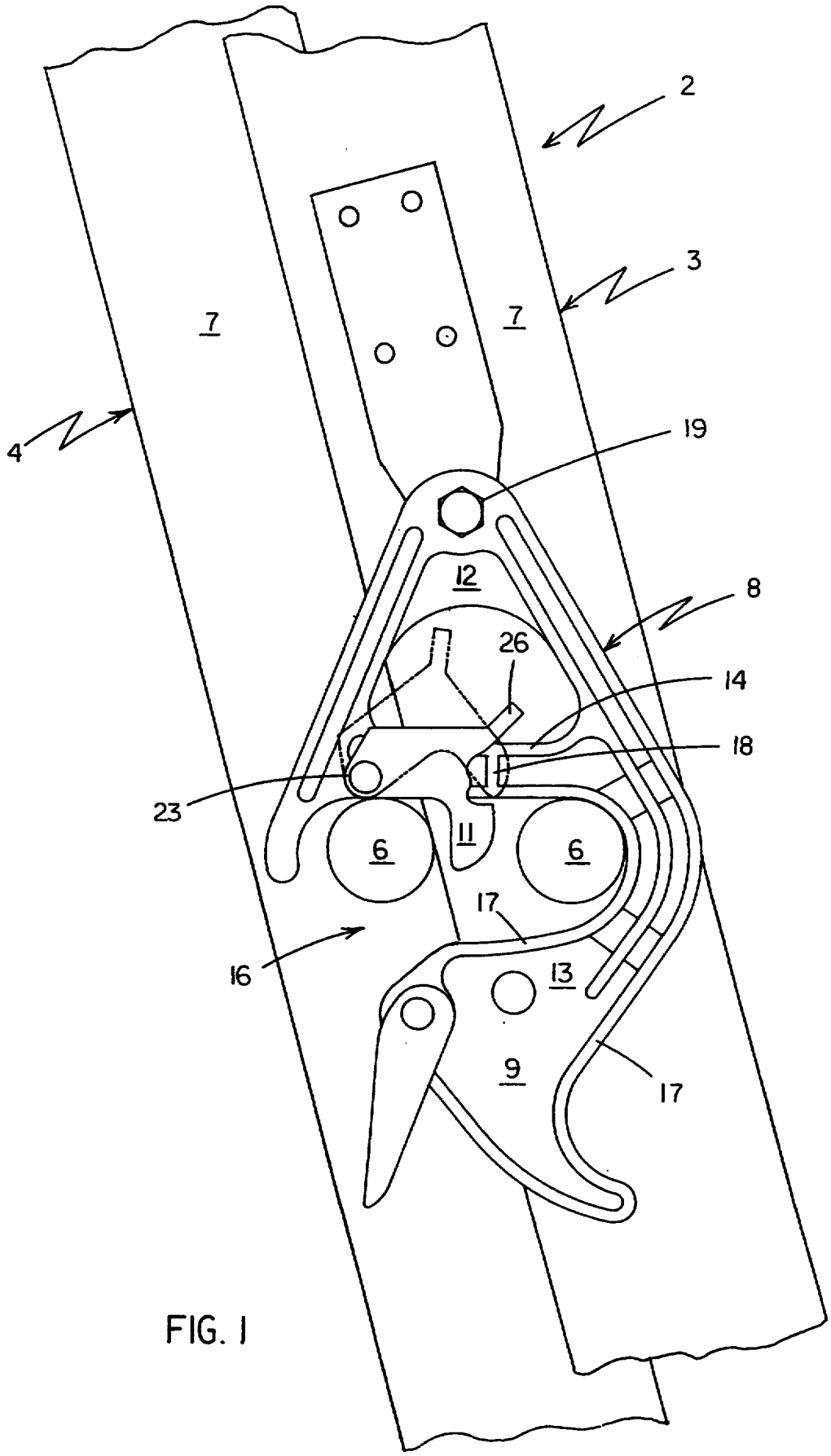
FIG. 1 is an overall partially broken away side view of a portion of the novel rung lock frame and latch assembly structure of FIGS. 2–5 described hereinafter, the inventive latch being mounted on a rung lock frame in latch fastened position with adjacent ladder rungs of otherwise relatively slidable ladder sections of an extension ladder (only a portion being shown), the phantom lines illustrating the latch assembly in open position.

As can be seen in the overall, partial view of FIG. 1 of the drawings, a longitudinally extendable extension ladder 2 is disclosed including at least two adjacent relatively slidable fly and base ladder sections 3 and 4, respectively, with the base ladder section 4 serving as the stationary section and fly ladder section 3 being the relatively movable section. The ladder sections can be formed from any one of a number of suitable materials such as fiber-glass or aluminum metal, as are the rung locks and spaced rungs described hereinafter. Each ladder section 3 and 4 includes a plurality of spaced ladder rungs 6 which generally are of circular or "D" cross-section and which extend normally between and are fastened to a pair of spaced ladder rails 7 (only one rail of each ladder being shown in FIG. 1). As above noted, one of the ladder sections serves as the base ladder section 4 and the other serves as the relatively fly ladder section 3. It is to be understood that the present invention is not to be considered as limited to the number or type of ladder sections disclosed, or to the nature of movement of the rung lock frame means or latching means relative to the ladder sections or to each other.

In accordance with the present invention, the novel rung lock frame and latching assembly 8 can be pivotally mounted on one of the relatively slidable ladder sections of an extensible ladder. Advantageously, assembly 8 which includes rung lock frame 9 and a moveable latching mechanism 11 can be movably mounted as a rung cooperating spaced pair of rung lock and latching assemblies 8 in or adjacent the inside opposed faces of the pair of ladder rails 7 of the fly ladder section 3. Further and advantageously, the assemblies 8 may be mounted in spaced relation above and engageable with the lowest ladder rung 6 of fly ladder section 3.

Each rung lock frame 9, which also can be formed from any one of a number of metallic or plastic materials such as a selected aluminum alloy metal, is shaped to include apertured or opened upper and lower rung portions 12 and 13 with a bar member 14 extending therebetween. The lower portion 13 is open-ended, as at 16, so as to provide a C-liked shaped mouth opening, the mouth being geometrically sized and configured to releasably engage both of a preselected pair of adjacently positioned rungs 6, 6 of fly ladder section 3 and base ladder section 4 respectively when the rail mounted rung lock frame 9 has been pivoted into rung locking position. It is to be noted that each rung lock frame 9 is so formed that the opposite longitudinally extending faces thereof-including the frame bar member 14 which divides rung portions 12 and 13—are recessed, thus reducing overall frame weight and leaving longitudinally extending edge strengthening ribs 17 and 18. Only one face of frame 9 is disclosed. It is to be understood that the opposite face of frame 9 is a mirror-image of the face shown. Ribs 17 are located along preselected edge areas of opposed face edges of rung lock frame 9 and include opposed ribs 18 on opposite faces of frame 9. Ribs 18 are positioned to extend normally between the spaced opposed longitudinally extending edge ribs 17 on opposite face of bar member 14 at a location intermediate the extremities of bar member 14. As will be seen hereinafter, ribs 18 not only serve as strengthening ribs, like edge ribs 17, but also serve as a guide member for latch 11 pivotally mounted adjacent one extremity of bar member 18 above open end 16 of the lower apertured portion 13 of rung lock frame 9. It is to be noted that rung lock frame 9 can be provided with a pin receiving through pivot hole 19 at one extremity of frame 9. This pivot hole 19 allows for pivotal mounting of rung lock frame 9 about an inner face of a side rail 7 of fly ladder section 3. The rung lock frame 9 is so spaced from a preselected rung 6, such as the lowest rung, that the open-end 16 and mouth of lower apertured portion 13 can engage with the lowest rung 6 on fly ladder section 3 and with an adjacent preselected rung 6 on base ladder section 4.

In accordance with another feature of the present invention and as can be seen in FIG. 1 of the drawings, above mentioned latch 11 of the rung lock frame and latch assembly 8 is pivotally mounted at one extremity thereof on aforedescribed rung lock frame 9 adjacent the extremity of bar member 14 which divides the upper and lower apertured portions 12 and 13 of frame 9. It is to be noted that latch 11 is pivotally positioned adjacent the extremity of bar member 14 at a location above the open end 16 of the mouth of C-shaped lower rung portion 13 of rung lock frame 9. Referring to FIGS. 2-5 of the drawings, it can be seen that latch 11, which advantageously can be formed from a suitable high strength impact plastic includes spaced, parallel, mirror image facing "L"-shaped sides 21 with portions of the extremities cornered and cut away to facilitate pivotal operation. "L" shaped sides 21 are joined along the upright edges of the "L" by a base member 22 so as to provide a U-shaped latching structure pivotally mounted on a suitable pin extending through a through aperture 23 selectively positioned in rung lock frame 9, the through aperture 23 being located at the extremity of bar member 14 above the open end 16 of lower frame portion 13. The base member 22 joining the upright portion of L-shaped sides is so sized that the U-shaped latching structure straddles and engages the opposite faces of bar member 14 along rib 18, the aperture in the tipper rung portion 12 of rung lock frame 12 being sufficient to accommodate the pivotal movement of latch 11 above bar member 14. It is to be noted that the upright edges of the L-shaped sides 21 are of sufficient length that the bottom lower corresponding edges or base edges of the L-shaped sides 21 are positioned to engage along the faces of guide ribs 18 so as to not be bound in the recessed faces of bar member 14. In this regard, the opposed inner faces of the bottom portion of the L-shaped sides 21 of latch 11 are provided with raised, inclined ramp surfaces 24 to enhance the slidable movement of the bottom portion of the L-shaped sides over intermediate guide ribs 18 on opposed faces of bar member 14. To pivotally actuate the latch 11 so that the spaced parallel base portions of the L-shaped sides 21 pivotally extend into the opened C-shaped mouth 16 of the lower portion 13 of rung lock frame 9, such arrangement thus providing a pair of restraining tongues which releasably augment the rung lock frame 9 when engaged with a selected pair of opposed rungs 6 of relatively slidable fly and ladder sections 3 and 4 of extension ladder 2, a readily grippable actuating tab member 26 is provided to extend at an angle from the upright edge joining base member 22.

From the above description, it can be seen that a unique, straight forward, readily and economically manufactured rung lock frame and latching assembly is provided for use with various types of extension ladders.

The invention claimed is:

1. In combination with an extension ladder having at least two adjacent relatively slidable ladder sections, each section of which includes a plurality of spaced rungs normally extending between and fastened to a pair of spaced ladder rails, one of said ladder sections serving as a base ladder section and the other serving as a movable fly ladder section, a rung lock frame and latching assembly for selectively, releasably locking and releasably augmentally latching a pair of adjacently positioned rungs of said relatively slidable ladder sections comprising:

rung lock frame means movably suspended relative said adjacent relatively slidable ladder sections, said frame means including a mouth portion geometrically sized and configured to releasably engage both of a pair of adjacently positioned rungs of said adjacently positioned rungs of said adjacent relatively slidable ladder sections; and mechanical latching means including manually operable tongue stop means movably mounted on said rung lock frame means to be selectively and independently releasable and augmentally cooperable in said mouth portion of said frame means between said pair of adjacently positioned rungs of said ladder sections when so moveably and releasably engaged to serve as a positive stop cooperative with said rung lock frame means to limit rung lock frame motion, thus to releasably and augmentally restrain motion of said rung lock frame means when independently moved in rung engaged position stopping disengagement of said rung lock frame means and relative longitudinally slidable movement of said ladder sections when said tongue stop means has been moved to such engaged position.

2. The rung lock and latching assembly of claim 1, said mechanical latching means being pivotally mounted on said ladder section serving as a fly ladder section.

3. The rung lock and latching assembly of claim 1, said rung lock frame means being pivotally connected at its upper portion from said ladder section serving as said fly ladder section.

4. The rung lock and latching assembly of claim 1, said rung lock frame means including integral upper and lower portions with a bar member extending therebetween with said lower portion being open-ended to further define said mouth portion geometrically sized and configured to releasably engage both of a pair of adjacently positioned rungs in said open ended lower portion of said rung lock frame mean and with said mechanical latching means being pivotally mounted adjacent one extremity of said bar member with said tongue stop means on said bar member of said rung lock frame means adapted to be pivoted relative said bar member to be releasably cooperable relative said pair of adjacently positioned rungs when releasably engaged by said mouth portion of said OPEN ended lower portion of said rung lock frame means to releasably and augmentally positively fasten said rung lock frame means in engaged position.

5. The rung lock and latching assembly of claim 4, said upper and lower portions of said rung lock frame means being apertured with said bar member extending therebetween, said latching means pivotally mounted adjacent one extremity of said bar member, comprising spaced, parallel, facing mirror-image L-shaped sides joined along the upright edges thereof by a base member sized to provide a U-shaped latching structure pivotally engageable with said bar member with the spaced parallel bases of said L-shaped sides pivotally extendable into said lower mouth portion to provide said tongue means to releasably and augmentally limit motion of said rung lock frame means when in engaged position with said rungs.

6. The rung lock and latching assembly of claim 5, said rung lock frame means having the faces thereof including said bar member recessed at preselect areas thereof to reduce overall weight and to leave longitudinally extending edge strengthening ribs at preselected areas thereon including ribs extending between spaced opposed longitudinally extending edges on said bar member with strengthening and guide ribs extending therebetween intermediate the extremities of said bar member.

7. The rung lock and latching assembly of claim 6, said latching means including opposed, inclined ramps preselectively positioned on the inner base faces of said L-shaped sides of said latching means to slidably cooperate with said strengthening and guide ribs on said bar member.

8. In combination with a rung lock frame including a mouth portion for releasably engaging and locking oppositely positioned rungs of relatively slidable ladder sections of an extension ladder, a manually operable latching structure selectively and independently moveably mounted relative said rung lock frame and said ladder sections to have a portion thereof moveably positionable between rung lock frame engaged oppositely positioned rungs of said ladder sections to positively limit releasing movement of said rung lock frame when said oppositely positioned rungs of said ladder sections are so engaged by said mouth portion of said rung lock frame and to serve as a positive stop by stopping disengagement of said rung lock frame means and relative longitudinally slidable motion of said ladder sections when so moveably positioned.

9. The rung lock frame and latching structure of claim 8, said rung-lock frame including a guide rib member and said latching structure including an inclined ramp slidably cooperative therewith.

10. In combination with an extension ladder having at least two adjacent relatively slidable ladder sections, each section of which includes a plurality of spaced rungs normally extending between and fastened to a pair of spaced ladder rails, one of said ladder sections serving as a base ladder section and the other serving as a movable fly ladder section, a rung lock frame and latching assembly positioned above the lowest rung of said fly ladder section for selectively, releasably locking and releasably and augmentally latching a pair of adjacently positioned rungs of said relatively slidable base ladder and fly ladder sections comprising:

rung lock frame means including integral apertured upper and lower portions with a bar member extending therebetween with said lower portion being open-ended of C-like shape to define an open-mouth portion with the aperture thereof which is geometrically sized and configured to releasably engage both of a pair of adjacently positioned rungs in said open-mouthed apertured lower portion, said rung lock frame having the opposite longitudinally extending faces thereof including said bar member recessed to reduce overall frame weight and to leave longitudinally extending edge strengthening ribs at preselected areas and further including ribs extending normally between spaced opposed longitudinally extending ribs on opposite faces of said bar member intermediate the extremities of said bar member which intermediate ribs serve as strengthening and guide ribs, said rung lock frame having a through pivot hole therethrough at one extremity of said frame above said apertured upper portion thereof for pivotal mounting of said rung lock frame on a rail of said fly ladder section in spaced relation above the lowest rung of said fly ladder section so that said open-mouth lower portion of said rung lock frame can engage with said lowest rung on said fly ladder section and a selected adjacent rung on said base ladder section; said latching means being pivotally mounted adjacent one extremity of said bar member above said aperture of said open-end mouth portion of said lower portion of said rung lock frame, said latching means including spaced, parallel, mirror-image facing L-shaped sides joined along the upright edges thereof by a base member sized to provide a U-shaped latching structure pivotally engageable and straddling said recessed bar member with the inner faces of the bases of said L-shaped sides including opposed, inclined ramps positioned to slidably cooperate with said guide ribs on said opposite faces of said bar member intermediate the extremities thereof, said latching means further including an actuating tab member extending from said upright edge joining base member to actuate said latch means so that the spaced parallel bases of said shaped sides can pivotally extend into said open mouth aperture of said lower portion of said rung lock frame to provide a pair of restraining tongues to releasably and augmentally fasten said rung lock frame when in engaged position with said opposed rungs of said otherwise relatively slidable ladder sections.

* * * * *